United States Patent [19]

Uchida et al.

[11] Patent Number: 5,056,734

[45] Date of Patent: Oct. 15, 1991

[54] AUTOMATIC WINDER

[75] Inventors: Hiroshi Uchida, Oumihachiman; Toshio Yamauchi; Yoshiyuki Ichiba, both of Kyoto, all of Japan

[73] Assignee: Murata Kikai Kabushiki Kaisha, Kyoto, Japan

[21] Appl. No.: 361,778

[22] Filed: May 26, 1989

Related U.S. Application Data

[63] Continuation of Ser. No. 107,294, Oct. 9, 1987, abandoned.

[30] Foreign Application Priority Data

| | | | |
|---|---|---|---|
| Oct. 11, 1986 | [JP] | Japan | 61-241798 |
| Feb. 20, 1987 | [JP] | Japan | 62-23674[U] |
| Feb. 25, 1987 | [JP] | Japan | 62-424425 |
| Feb. 26, 1987 | [JP] | Japan | 62-43997 |

[51] Int. Cl.[5] ..... B65H 59/22

[52] U.S. Cl. ..... 242/147 R; 242/150 R; 242/154; 242/155 M; 310/323; 310/326; 310/328

[58] Field of Search ..... 242/147 R, 147 M, 149, 242/150 R, 150 M, 154, 155 R, 155 M, 36, 45; 310/323, 326, 328

[56] References Cited

U.S. PATENT DOCUMENTS

| | | | |
|---|---|---|---|
| 2,578,620 | 12/1951 | Wilhelm | 242/45 |
| 2,586,037 | 2/1952 | Heffelfinger | 242/155 M X |
| 3,300,161 | 1/1967 | Hermanns | 242/154 |
| 3,797,775 | 3/1974 | White | 242/155 M |
| 3,844,498 | 10/1974 | Loepfe | 242/36 |
| 3,931,938 | 1/1976 | Hasegawa et al. | 242/45 |
| 3,991,954 | 11/1976 | Schwartz | 242/150 M |
| 4,292,868 | 10/1981 | Werffeli | 242/36 X |
| 4,330,094 | 5/1982 | Mayer | 242/36 |
| 4,346,551 | 8/1982 | Yanobu et al. | 242/155 R |
| 4,361,777 | 11/1982 | Mettler | 310/323 X |
| 4,435,666 | 3/1984 | Fukui et al. | 310/328 |
| 4,512,526 | 4/1985 | Tone et al. | 242/36 |
| 4,605,875 | 8/1986 | Bobbola | 310/323 |
| 4,644,213 | 2/1987 | Shibuya | 310/328 |
| 4,647,808 | 3/1987 | Shibuya | 310/328 |

FOREIGN PATENT DOCUMENTS

| | | | |
|---|---|---|---|
| 225541 | 5/1943 | Switzerland | 242/155 M |

*Primary Examiner*—Stanley N. Gilreath

*Attorney, Agent, or Firm*—Spensley, Horn, Jubas & Lubitz

[57] ABSTRACT

An automatic winder is provided with a tension sensor for detecting the tension of travelling yarn in each winding unit and a tensor for controlling the tension of yarn in accordance with a yarn tension variation signal provided from the tension sensor, to thereby eliminate the variation of yarn tension.

4 Claims, 8 Drawing Sheets

AUTOMATIC WINDER

This is a continuation of application Ser. No. 07/107,294 filed on Oct. 9, 1987, now abandoned.

FIELD OF THE INVENTION

The present invention relates to an automatic winder having a tensor which controls the tension of yarn on the basis of detected changes in tension of the yarn being drawn out from a spinning bobbin.

RELATED ART STATEMENT

Spinning bobbins obtained in a spinning frame, particularly a ring spinning frame, are fed to winders, where they are rewound to packages of predetermined yarn quantity and shape.

The yarn on each spinning bobbin which has been fed to a predetermined position of a winding unit in each winder is pulled out upwards in the axial direction of the bobbin, then the yarn thus separated from the yarn layer travels while ballooning and is taken up to a package while being traversed by a traverse device past a tensor, etc.

As the yarn layer on each spinning bobbin diminishes with winding operation of a winder, the thus-diminished yarn layer twines round only the lower end portion of the bobbin and the yarn pulled out therefrom travels upwards while twining round the surface of the bobbin. In this case, the angle of separation from the yarn layer decreases, so tension is applied to the travelling yarn due to friction between yarn portions or the contact of the yarn with the bobbin, and this may cause breakage of the yarn. Such a phenomenon occurs more easily in a high-speed winder in which the yarn travelling speed reaches 2000 m/min.

Moreover, since the yarn being drawn out in a diminished state of yarn layer travels in contact with the yarn of the underlying layer, the yarn of a length corresponding to one circumference of the bobbin is pulled out at a time, or the package formed in the winder may have a so-called stepped winding, annual ring-like winding or wrinkles with changes in tension, which may cause sloughing, collapse of the package or breakage of the yarn.

Further, since the tension at the beginning of unwinding of yarn from a single spinning bobbin is low, the yarn is taken up onto package at a low tension, and so the yarn layer of low tension may be expanded out of an end face of the package due to the pressure of the overlying yarn layer. Since usually several to ten odd spinning bobbins are used to obtain one package, the above expanded portion appears at every certain period, thus causing package of a defective winding called an annual ring-like winding.

The occurrence of such yarn breakage or defective package causes lowering of the operating efficiency of the winder and of productivity.

OBJECT AND SUMMARY OF THE INVENTION

It is an object of the present invention to provide a tension device for controlling the tension of a yarn in accordance with a yarn tension variation of a yarn taken up from a spinning bobbin.

The automatic winder of the present invention is provided with a tension sensor for detecting the tension of travelling yarn in each winding unit and a tensor for controlling the tension of yarn in accordance with a yarn tension variation signal provided from the said tension sensor, to thereby eliminate the variation of yarn tension.

The present invention proposes many embodiments of the tension device whereby the tension of travelling yarn may be detected to control the tension and the detected tension may be controlled.

A change in tension of yarn being drawn out from a spinning bobbin is detected by the tension sensor, and when the tension changes from a preset level, the tenser is operated to control the yarn tension is accordance with a signal provided from the tension sensor.

The tension sensor may further include an intermediate member provided for enlarging tension. The tension sensor may be constituted such that the contact pressure of the yarn is transferred to a piezoelectric element through a ceramic member provided or fixed on the surface of the piezoelectric element.

DETAILED DESCRIPTION OF THE INVENTION

Embodiments of the present invention will be described hereinunder with reference to the drawings.

Figure 1:
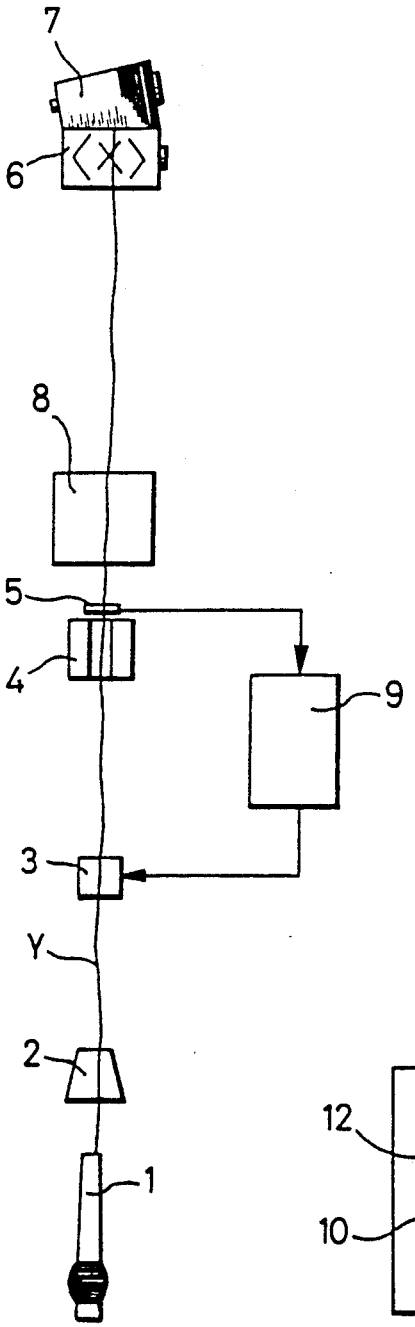
FIG. 1 is a schematic diagram of a winding unit embodying the present invention.

FIG. 1 shows an example of a winding unit as a constituent of an automatic winder according to the present invention.

Figure 2:
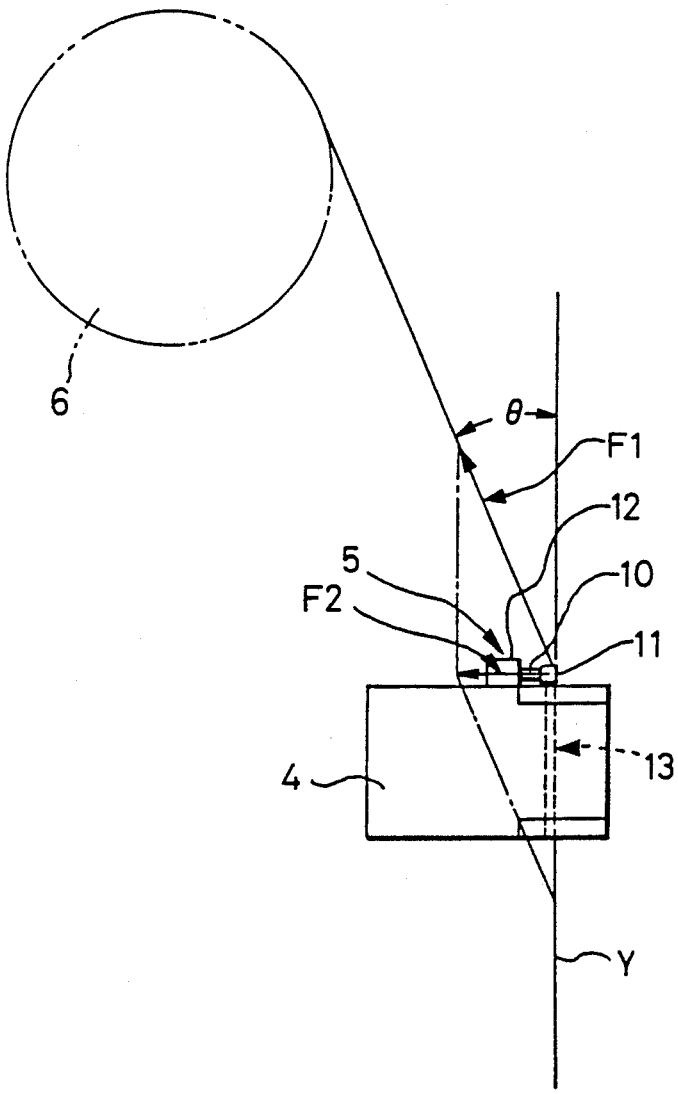
FIG. 2 is a side view showing an example of a mounted state of a tension sensor.
Figure 3:
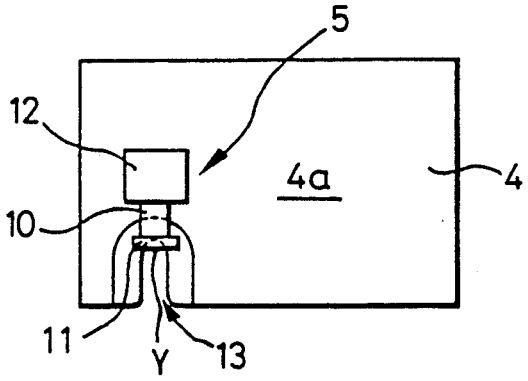
FIG. 3 is a plan view thereof.

Yarn Y drawn out from a spinning bobbin 1 passes through a balloon breaker 2, a tensor 3, a yarn defect detecting head 4 such as a slub catcher and a tension sensor 5, then is wound onto a rotating package 7. Numeral denotes a yarn joining device and numeral 9 denotes a controller which receives a tension variation signal from the tension sensor 5 and provides a command to the tensor to control the tension of the yarn Y. As the tension sensor 5 used in the present invention, one utilizing a piezoelectric element such as that shown in FIGS. 2 and 3 is used advantageously. Numeral 10 denotes a voltage element, to which is fixed a guide 11 for contact therewith of the yarn Y which is travelling. The piezoelectric element 10 is fixed and positioned to a base 12 which is fixed onto a frame 4a of the yarn defect detecting head 4 such as a slub catcher. Moreover, the guide 11 is provided so that the portion of the guide 11 which contacts the yarn is positioned adjacent one end of the slit 13 rather than within the slit 13.

Further, it is desirable for the tension sensor 5 to be provided at a bent point of the yarn travelling path, because the detection of tension can thereby be effected at all times. In FIG. 2, the tension sensor 5 is located in a position where the yarn travelling direction bends at an angle of $\theta$.

Figure 4:
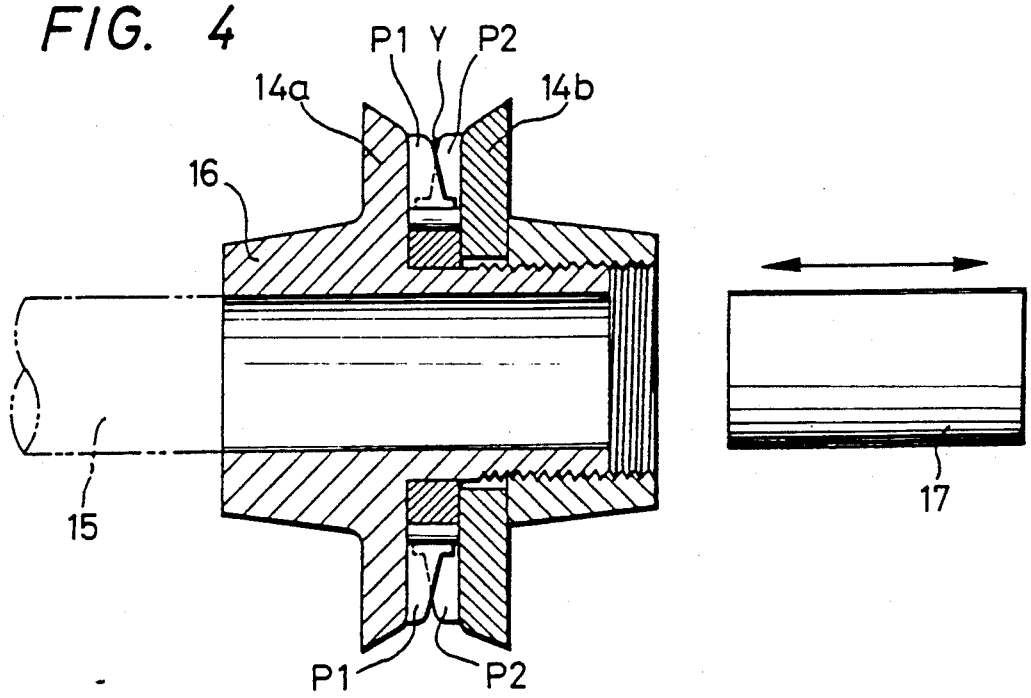
FIG. 4 is a sectional view showing an example of a tensor.
Figure 5:
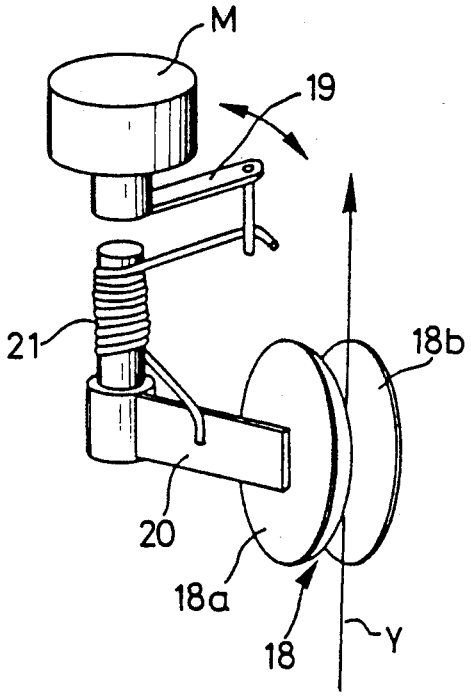
FIG. 5 is a perspective view showing another example of a tensor.
Figure 6:
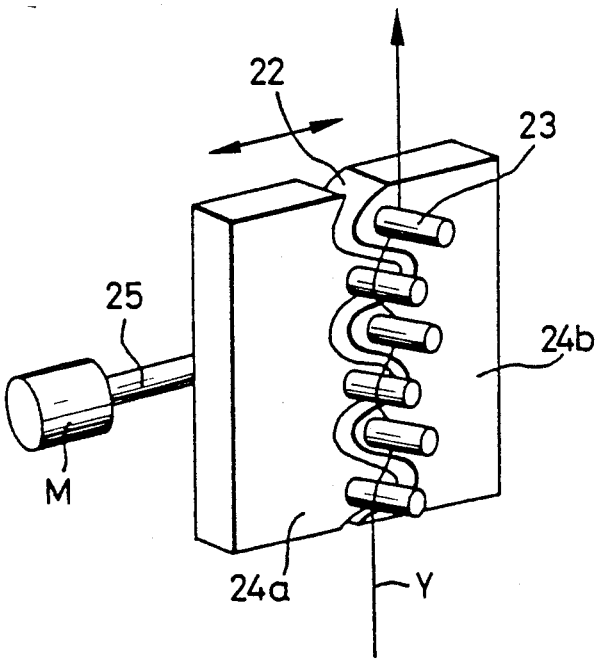
FIG. 6 is a perspective view showing a further example of a tensor.
Figure 7:
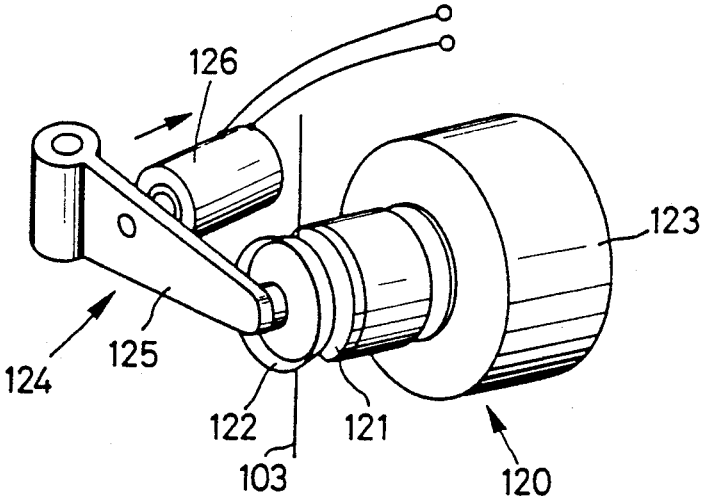
FIG. 7 is a schematic perspective view showing a still further example of a tensor.
Figure 8:
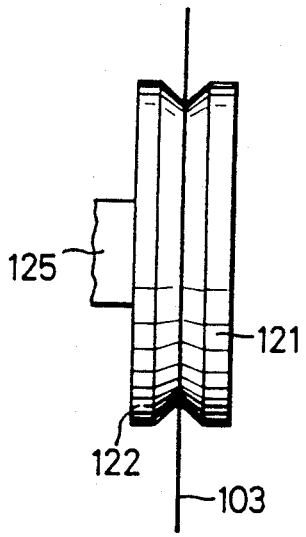
FIG. 8 is a front view of a principal portion thereof.
Figure 9:
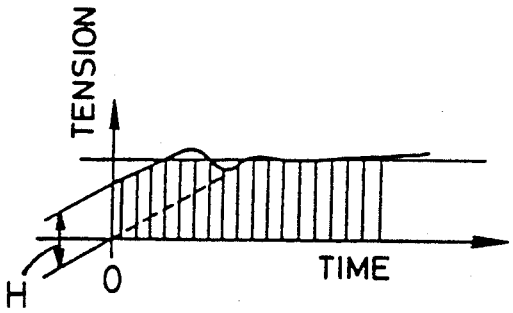
FIG. 9 is a graph showing tension imparted to yarn by means of a tensor shown in FIG. 1.

Examples of the tensor 3 are shown in FIGS. 4 to 6. In the example shown in FIG. 4, the tension device is composed of a roller 16 having a pair of disks 14a and 14b and adapted to rotate freely on a shaft 15 under the tension of yarn Y which is travelling in a zig-zag fashion, and a solenoid 17 capable of axially approaching and leaving the roller 16, the disks 14a and 14b having a number of pieces $P_1$ and $P_2$ affixed radially to end portions of the disk surfaces and being disposed opposedly in engagement with each other so that the respective pieces are positioned alternately with each other. The tension of the travelling yarn Y is controlled continually by drawing the solenoid 17 close to the roller 16 to impart resistance to the rotation of the roller, thereby checking the rotation to strengthen the tension, or moving the solenoid away from the roller 16 to permit rotation, thereby weakening the tension.

FIG. 5 shows a second example of the tensor. As shown therein, in a tensor 18 of the type in which yarn Y is held between two disks 18a and 18b one of which is fixed and the other in pressure contact therewith, the disk 18a, which is movable, is supported rockably by a support arm 20, and a spring 21 is retained at both ends thereof by a rocking lever 19 adapted to rock with forward and reverse rotation of a motor M and also by the support arm 20 of the disk 18a, whereby the spring is supported in a suspended state. In this construction, the biasing force of the spring 21 is increased or decreased by the rocking motion of the rocking lever 19 induced by forward or reverse rotation of the motor M, thereby changing the urging force acting between the two disks 18a and 18b to control the tension of the travelling yarn Y continually.

Referring now to FIG. 6, there is shown a third example of the tension device, which is composed of two gate plates 24a and 24b provided on side faces thereof with intermeshing corrugated uneven surfaces 22 and a plurality of short rods 23 projecting from the tops of the waves in a direction orthogonal to the waving direction, and a drive mechanism 25 for moving the gate plate 24a forward and backward with rotation of a motor M to increase and decrease the degree of engagement of the corrugated uneven surfaces. As the gate plate 24a is moved forward or backward, the angle of contact with the short rods 23 of yarn Y which is travelling in a zig-zag fashion along the surfaces of the short rods is changed to control the tension of the yarn Y continually.

With increase in tension of the travelling yarn Y, pressure is applied to the piezoelectric element 10 on the tension sensor 5 to induce a mechanical strain, thus causing a change in voltage. More particularly, as shown in FIG. 2, tension $F_1$ induced by the travelling yarn presses the piezoelectric element 10 in terms of force $F_2$, so the pressure based on $F_2=F_1\sin\theta$ is converted to voltage and the increase in tension can be detected on the basis of the difference in voltage from a preset standard tension.

Such a change in voltage difference is transmitted as a signal to the controller 9 immediately to operate the controller, and in accordance with a signal provided from the controller the solenoid 17 is moved away from the roller 16 when the tensor is as shown in FIG. 4 to reduce the resistance to the rotation of the roller 16. In the case of such a tensor as shown in FIG. 5, the urging force of the spring 21 is weakened to weaken the holding force of the disks 18a and 18b for the travelling yarn Y. And in the case of such a tensor as shown in FIG. 6, the corrugated uneven surfaces 22 are brought into deep engagement with each other to mitigate the zig-zag bending of the travelling yarn Y to decrease the tension of the yarn. Upon decrease of tension of the travelling yarn Y, this condition can be detected from a voltage difference signal provided from the voltage element 10 on the tension sensor 5, so in accordance with a signal issued from the controller 9 the tensor 3 operates reversely from the above to increase the yarn tension.

Although the above three examples of the tensor 3 were given, there may be adopted any other types of tension devices if only they are so constructed to permit immediate change of tension of the travelling yarn in accordance with a signal provided from the controller 9.

Since the yarn tension controller in the winder of this embodiment is constructed as above, it is possible to transmit a yarn tension variation signal provided from the tension sensor immediately to the tensor to control the tension of the travelling yarn. As the winding operation of the winder proceeds, the yarn layer on the spinning bobbin diminishes so the yarn drawn out from the yarn layer travels upward while twining round the surface of the bobbin and the angle of separation from the yarn layer decreases, thus causing friction between yarn portions and contact of the yarn with the bobbin. In this condition, even if tension is applied to the travelling yarn, this can be detected immediately and the tension weakened to prevent breakage of the yarn or sloughing. Further, the gathering of yarn toward the central part of package due to low tension of yarn at the beginning of winding or the occurrence of stepped winding, annual ring-like winding or wrinkles due to variation in tension can be prevented. Such effects are outstanding particularly in a high speed winder whose travelling speed is 2000 m/min. Since the tension can be controlled without decrease of the yarn travelling speed, it is possible to attain a great improvement in operating efficiency of the winder and hence is productivity.

Referring now to FIGS. 7 to 10, there are illustrated still other examples of the tensor, in which a yarn 103 from a spinning bobbin is passed grippingly between friction plates 121 and 122 of a tensor 120 and is then conducted to a package 109. The tensor 120 is provided with a block 123 of desired shape which supports the friction plate 121 in a fixed state and a solenoid device 124 which supports the other friction plate 122 in a movable state.

The solenoid device 124 has an arm 125 which is rotatable about an axis generally parallel to the yarn 103 and a solenoid body 126 which controls the amount of rotation of the arm 125. The solenoid body 125 adjusts the amount of pressing of the friction plate 122 against the friction plate 121 through the arm 125 in accordance with command provided from a control circuit.

In this example, at the time of start-up of the yarn 103 onto the package the friction plate 122 is urged against the friction plate 121 through the solenoid body 126 to impart a strong tension to the yarn 103 located between the friction plates 121 and 122. The relation between this tension and time is as graphically shown in FIG. 9. As is apparent from the graph, the deficiency of tension in the initial stage is fully compensated for by tension H. After the rotation of the package reaches a predetermined level, the pressure exerted on the yarn 103 is reduced to maintain the yarn 103 at a constant tension. Consequently, the yarn layers on the package become equal in pressure to one another, whereby the collapse of winding is prevented.

Figure 10:
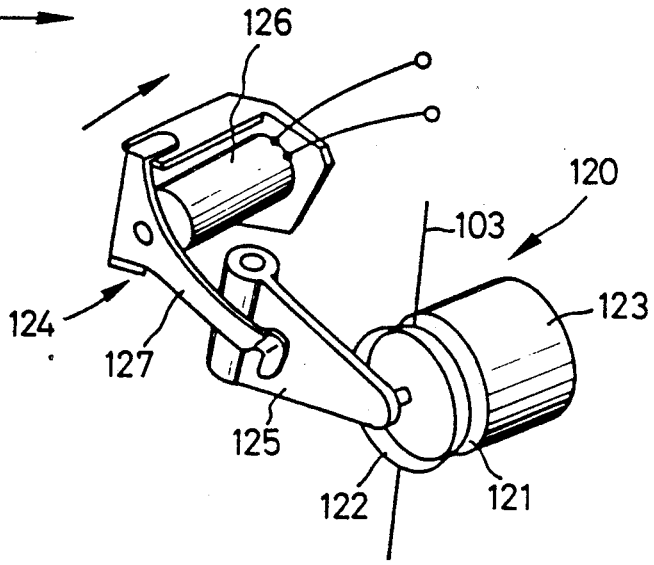
FIG. 10 is a schematic perspective view showing a still further example of a tensor.

FIG. 10 shows a still further example of the tensor, in which the above solenoid body 126 actuates the above arm 125 through a spring plate 127. In this tensor, the spring plate 127 buffers the action of the solenoid body 126, thereby permitting the frictional plate 122 to apply an appropriate frictional force to the yarn 103.

In this example, the tension of the yarn 103 can be adjusted more flexibly.

According to this example, as set forth above, sufficient tension can be applied to yarn by the tensor at the beginning of yarn winding to compensate for the deficiency in tension of the yarn at the time of start-up of rotation of each package, so the yarn layers wound on the package become sufficient and uniform in pressure and the collapse of yarn winding is sure to be prevented.

Another example of a tension sensor will be described below, which is capable of detecting a tension variation of yarn positively and in which an intermediate member for enlarging tension and transmitting the enlarged tension to the sensor is disposed between a tension sensor body and a tension detecting member which is tensionally displaced in contact with yarn.

Figure 11:
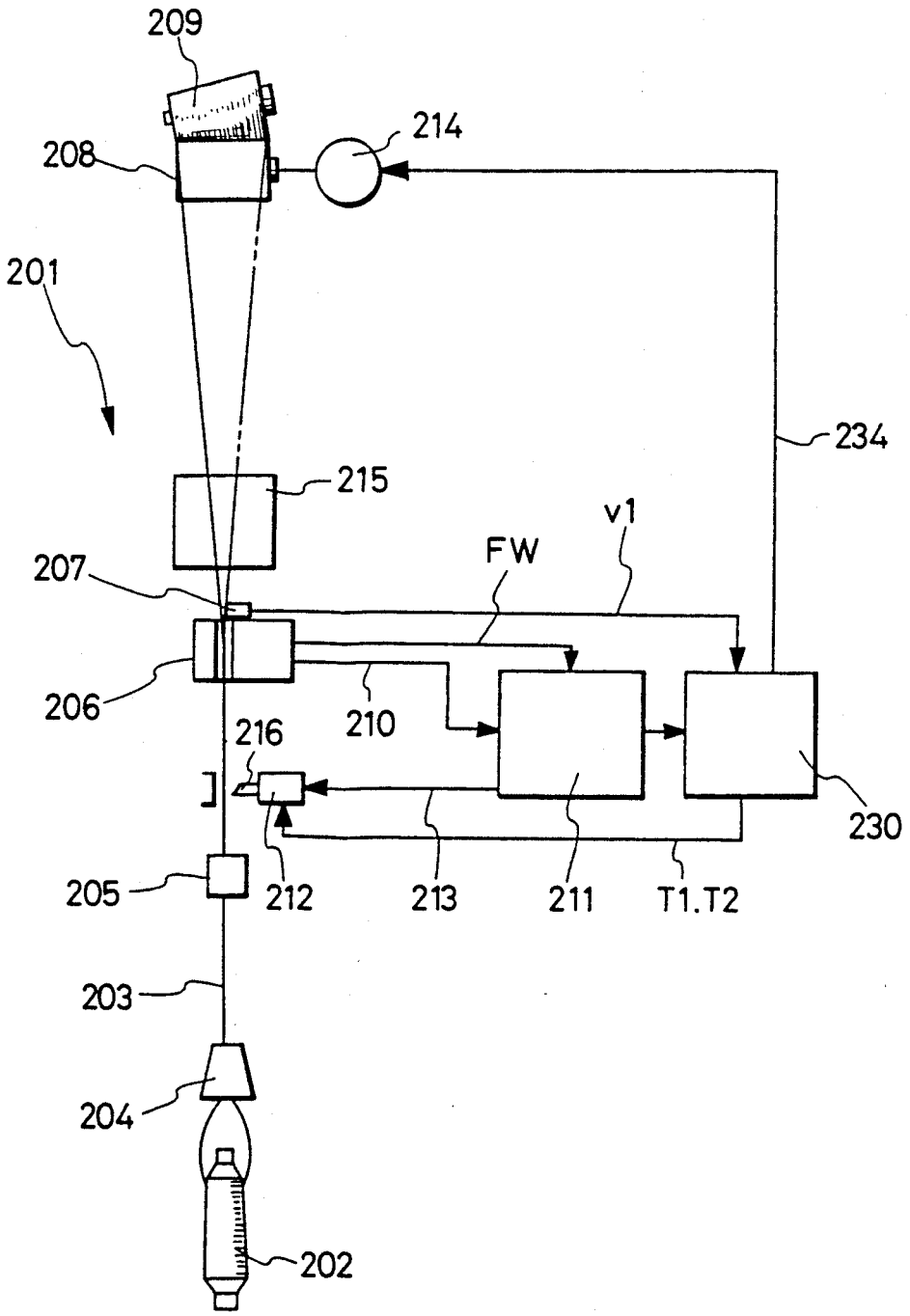
FIG. 11 is a schematic diagram showing another example of a winding unit according to the present invention.

In FIG. 11, which shows an example of a winding unit 201, a yarn 203 unwound from a bobbin 202 passes through a balloon breaker 204, a tensor 205, a slub catcher 206 and a tension sensor 207 and is taken up onto a package 209 through a traverse drum 208.

During the take-up operation, a change in thickness of the yarn is fed as an electric signal 210 to a yarn clearer 211, where it is compared with a reference value. In the event the result of the comparison exceeds an allowable range, it is judged that a defective portion of the yarn has passed, whereupon a cutter operation command signal 213 is provided from the clearer 211 to a cutter driving device 212 to effect cutting of the yarn. At the same time, a yarn travel signal FW provided from the slub catcher 206 turns OFF, and upon detection of the yarn breakage, an OFF command signal for a traverse drum driving motor 214 is issued from the clearer 211 to stop the rotation of the drum 208.

Subsequently, a command signal to the effect that a yarn joining operation should be started by a yarn joining device 215 is output from the clearer 211, whereby there is performed joining operation by a known joining means.

Thus, in the case where slub is detected and the cutting of yarn is made forcibly using a cutter 216, the portion of the yarn to be cut is the portion located in the position of the cutter 216, so the package-side yarn end resulting from the cutting of the yarn is taken up on the package, while the bobbin-side yarn end will never twine round the drum because it is located below away from the drum 208.

However, in the event a portion of the yarn of a low strength slips off of the drum, causing a so-called breakage on drum, or in the event of tension breakage due to high tension, the bobbin-side yarn end moves in the traverse direction along the groove of the drum just after the yarn breakage, but it finally twines round the groove interior of the drum.

Therefore, in this example, as shown in FIG. 11, the tension sensor 207 is provided midway in the yarn travelling path to detect tension variation in an allowable range during travel of the yarn. Just before occurrence of the foregoing breakage on drum, the yarn tension rises suddenly and this increase in tension is detected by the sensor 207, whereupon the yarn is cut forcibly.

Although in FIG. 11 the yarn cutter is separate from the slub catcher 206, there may be used a cutter which is incorporated in the slub catcher. The cutter may be disposed in any position. But from the standpoint of decreasing the quantity of useless yarn waste it is convenient and desirable for the cutter to be positioned as close as possible to the drum 208 as long as its position does not cause any obstacle to the traverse motion of the yarn.

Figure 13:
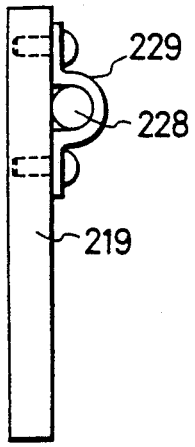
FIG. 13 is a side view thereof.
Figure 12:
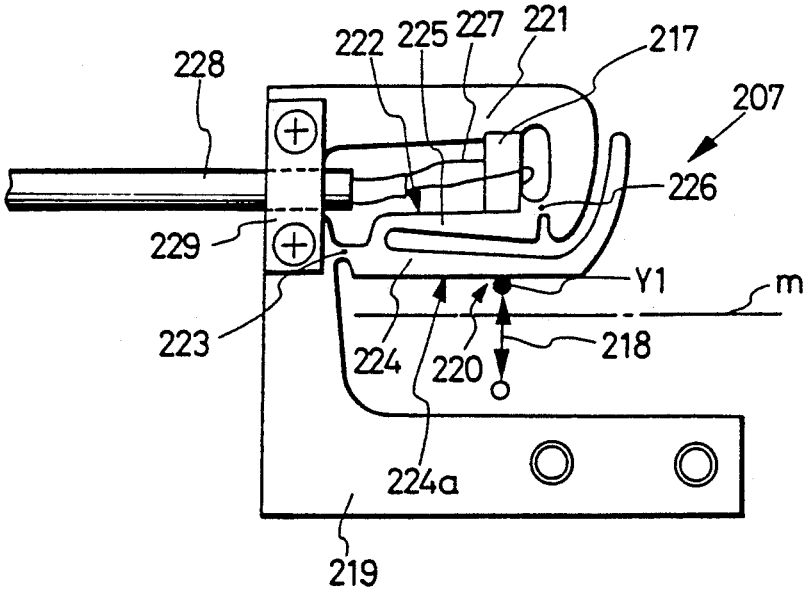
FIG. 12 is plan view showing an example of a tension sensor according to the present invention.

As the tension sensor 207 there may be adopted, for example, such a piezoelectric element 217 as shown in FIGS. 12 and 13. The piezoelectric element 217 is formed so that a mechanical strain is developed by a pressure applied from the exterior and a change in voltage is induced by such stain. It is desirable that the piezoelectric element 217 can react even against an extremely slight change in pressure.

As shown in the figures, the piezoelectric element 217 is mounted so that it can detect a tension variation of the yarn at therefore, the yarn will twine around the drum very little or not at all. The reference mark "m" represents the center of the traverse width. The tension sensor 207 is composed of a mounting portion 219, a tension detecting portion 220, a sensor support portion 221, and an intermediate member, or a tension enlarging/-transferring portion 222 disposed between the detecting portion 220 and the sensor support 221. More specifically, the mounting portion 219 is formed with a first rocking piece 224 through a first joint portion 223, the rocking piece 224 being rockable about the joint portion 223 as a fulcrum. One side 224*a* of the rocking piece 224 is within the traverse range of the yarn Y1 and it comes into contact with the yarn at every reciprocation of the yarn Y1, so the urging force induced by the tension of yarn is exerted thereon, thus allowing it to be displaced about the joint portion 223.

Figure 14:
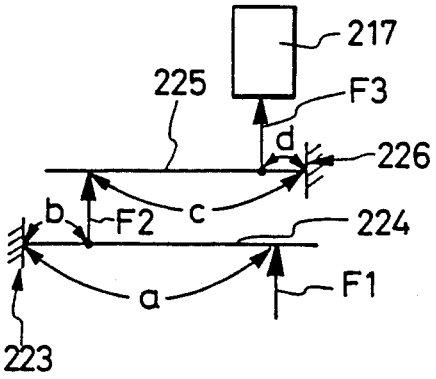
FIG. 14 is a schematic view showing a relation of transfer of an urging force induced by yarn tension to the sensor.

Further, a second rocking piece 225 is connected between the joint portion 223 of the first rocking piece 224 and the yarn tension detecting position 220, the rocking piece 225 being rockable about a second joint portion 226 as a fulcrum. As shown in FIG. 14, an urging force Fl exerted on the position of distance a from the fulcrum 223 of the first rocking piece 224 becomes F2 in the position of distance b from the fulcrum 223, which force F2 is equal to a/b×F1, thus enlarged to a/b times.

As a result of the force F2 acting on the position of distance c from the fulcrum 226 of the second rocking piece 225, the force F2 becomes F3, which is equal to c/d×F2, in the position of distance d from the fulcrum 226 of the second rocking piece 225, that is, in the position of direct action on the sensor 217.

Therefore, from the relation among the forces F1, F2 and F3, the force F3 exerted on the sensor 217 becomes equal to a/b×c/d×F1. Thus, the urging force F1 induced by the yarn tension in the detecting position 220 is enlarged to (a/b×c/d) times and this enlarged force is exerted on the sensor 217, provided a>b and c>d. For example, in the case of a=c=11 mm and b=d=3 mm, the urging force becomes 11/3×11/3=13.4 and thus even a slight pressure change is enlarged to 13.4 times.

In FIG. 12, a supporting cord 228 for an electric wire 227 connected to the piezoelectric element 217 is fixed and supported on the mounting member 219 by means of a clamping piece 229.

Figure 15:
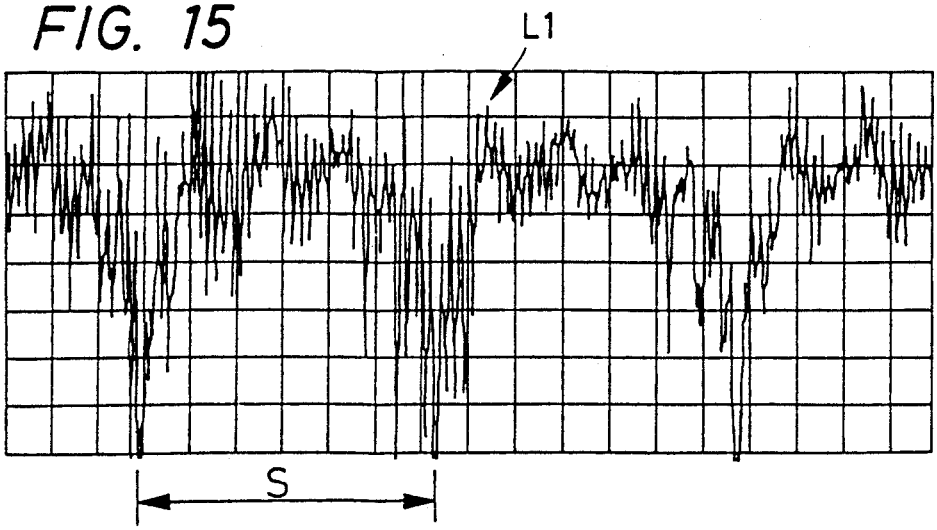
FIG. 15 is a graph showing variations of tension obtained by the sensor.
Figure 16:
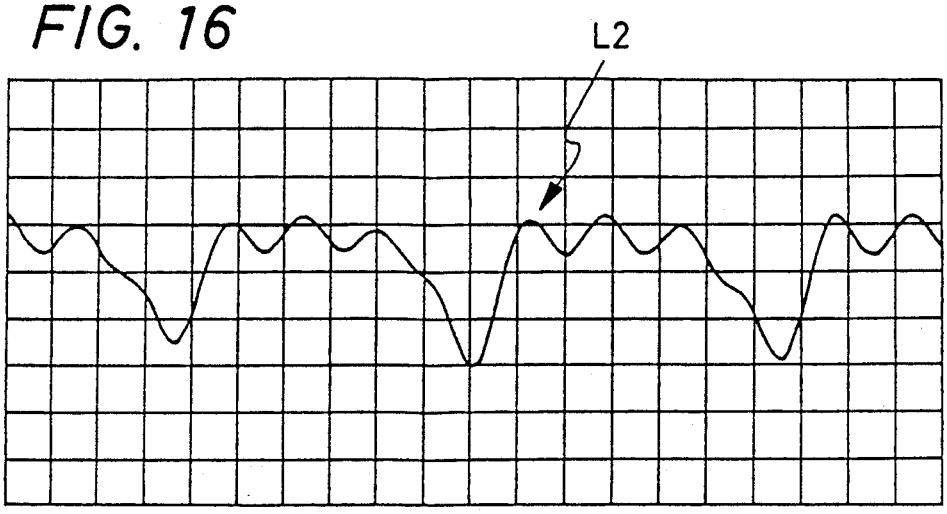
FIGS. 16 and 17 are diagrams obtained by processing the signals of FIG. 15.
Figure 17:
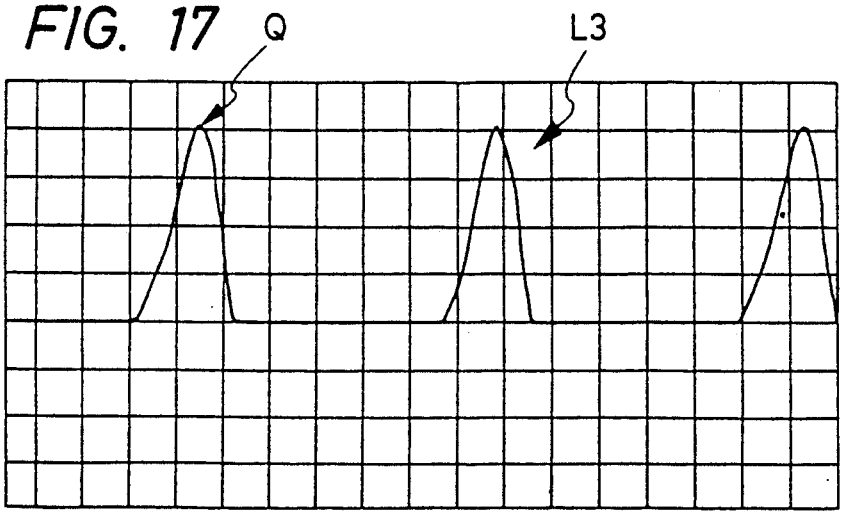
Figure 18:
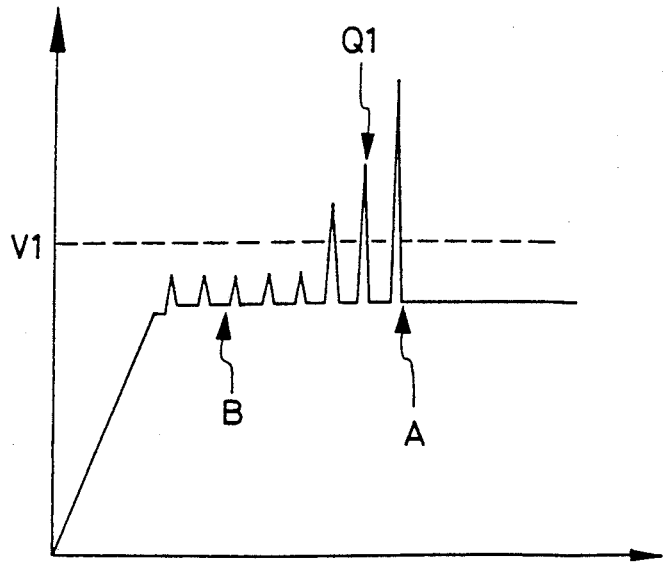
FIG. 18 is a diagram showing variations of tension in the case of occurrence of tension breakage.

FIGS. 15 to 17 show in what state the tension detection is effected by the sensor 207. Raw data L1 shown in FIG. 15 is obtained according to the tension of travelling yarn which comes into pressure contact with the detecting position 220 at every reciprocation of the yarn. The distance S between the greatest change portions corresponds to the time of one traverse of the yarn. It is the waveform diagram L2 of FIG. 16 that shows the data L1 after the elimination of noise. And it is the diagram L3 of FIG. 17 that has been obtained by extracting only greatest change portions. A variation in tension can be detected by comparing a peak Q in the diagram L3 with a certain preset value. FIG. 18 show in what state the yarn tension varies when there occurs tension breakage near the drum. At point B before the point A at which breakage on drum occurs, there appears the normal tension, but at the point A there is observed a sudden rise (Q1) of tension temporarily. Then, upon occurrence of yarn breakage, the yarn no longer traverses, so the sensor 207 is free from pressure based on tension, that is, no tension variation will be detected. Even if the yarn should twine round the drum, the normal traversing motion will not be performed, the yarn merely twining round a certain groove of the drum, so there will be detected no tension variation.

Since there is no signal input in the sensor 207 despite travelling of the yarn, it can be judged that the twining round the drum is occurring.

The travelling of yarn can be detected by a detecting function incorporated in the yarn clearer or by a mechanical sensing piece such as a yarn feeler.

Figure 19:
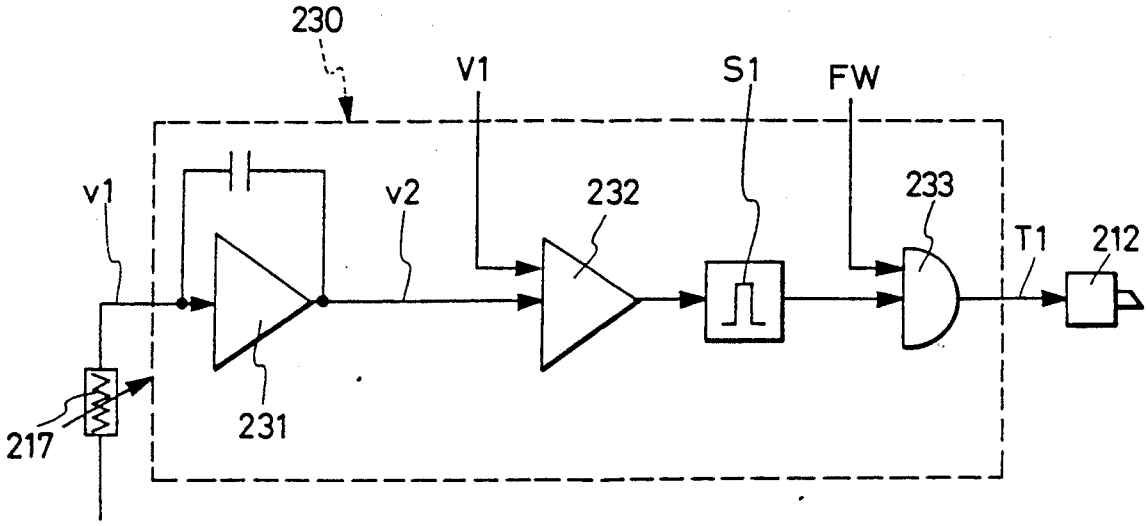
FIG. 19 is a circuit diagram showing an example of a control circuit in FIG. 11.

FIG. 19 shows an example of a control circuit 230 which is for performing a cutting processing upon detection of yarn breakage on drum. A level signal v1 provided from the piezoelectric element 217 of the tension sensor 207 is converted through an amplifier 231 into a signal v2 which is suitable for comparative calculation. The signal v2 is fed to a comparison circuit 232 to which has been fed a preset level V1 of high tension shown in FIG. 18.

Thus, the level signal v2 provided from the piezoelectric element 217 is fed to the comparison circuit 232, in which it is compared with the preset level v1. When it exceeds the preset level, the comparison circuit 232 outputs a breakage-on-drum signal S1, which is ANDed in an AND circuit 233 with a yarn present signal FW provided from the yarn clearer 211. As a result, when there occurs yarn breakage on the drum and yarn is present in its travelling path, a cutter drive signal T1 is output from the AND circuit 233 to operate the cutter 216 shown in FIG. 11.

Thus, even in the event of yarn breakage on the drum, an intermediate portion of the yarn between the bobbin side and the drum-side yarn end is cut forcibly at once, so the yarn is no longer drawn out from the bobbin side. The yarn portion corresponding to the length between the cutter 216 and the drum 208 shown in FIG. 11 twines around the drum.

For example, assuming that during winding at a yarn travelling rate of 2000 m/min it took 15 m sec. from the occurrence of yarn breakage on the drum until operation of the cutter 216, the length of yarn which may travel during that period is about 50 cm. Actually such a length of yarn will probably be blown off outwards by the centrifugal force of the drum without twining round the drum. One extremity Y1 of the range of movement 218 through which the yarn traverses.

Therefore, if the cutter 216 shown in FIG. 11 is operated almost simultaneously with the occurrence of yarn breakage on the drum, the yarn which is free at both ends is of the length between the drum 208 and the cutter 216. Even if the yarn of that length twines round the drum, it has already been disconnected from the spinning bobbin, so there will be no yarn drawn out from the spinning bobbin 202 and thus the accident of a large quantity of yarn twining round the drum is prevented.

The abnormal-state signal S1 which is generated upon occurrence of any abnormal state in tension is used as an OFF signal for the traverse drum driving motor. In this case, an OFF signal 234 is output from the control circuit 230 to stop the operation of the motor 214. Consequently, even if the yarn twines round the drum, the drum is prevented from continuing its rotation and thus it is possible to prevent the yarn from being drawn out from the bobbin.

In this embodiment, as set forth above, even in the case of a low tension of yarn, the tension can be input to the sensor in an enlarged state, thus permitting positive detection of a variation of tension.

Figure 22:
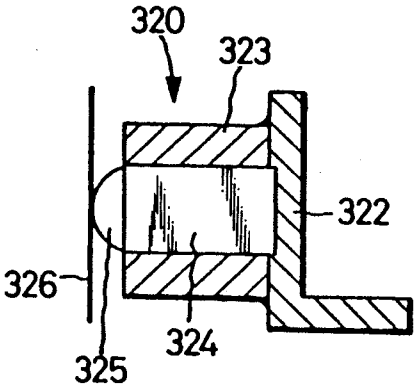
FIG. 22 is a right-hand side sectional view of FIG. 21.
Figure 21:
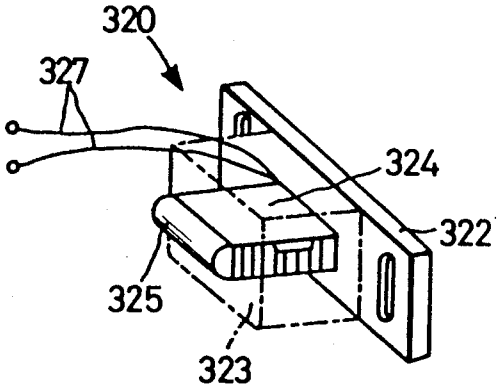
FIG. 21 is a detailed perspective view thereof.
Figure 20:
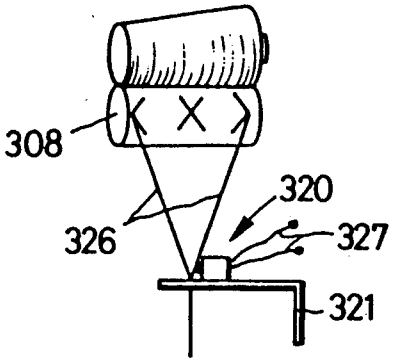
FIG. 20 is a schematic explanatory view of a principal portion of a yarn tension sensor according to a further example of the tension sensor used in the invention.

Referring now to FIGS. 20 to 22, there is shown a further example of a tension sensor. This tension sensor is provided in the yarn travelling path between the feed-side bobbin and the take-up-side package to detect the tension of yarn. More specifically, the tension sensor of this example has a piezoelectric element, a vibration damper which holds the piezoelectric element, a ceramic member fixed on the surface of the piezoelectric element to transfer the contact pressure of the yarn to the piezoelectric element, and an electric circuit which calculates the tension of the yarn on the basis of a change in voltage of the piezoelectric element. And it is disposed in the position of contact with the travelling yarn at a traversing end which yarn is being taken up onto a package while being traversed by a traverse device such as a traverse drum.

The yarn fed from the feed bobbin comes into intermittent contact with the ceramic member and is wound onto the take-up side package while pressing the piezoelectric element. The piezoelectric element detects the contact pressure of the yarn continually to detect a change in tension of the yarn before and after breakage of the yarn and thus detect yarn breakage. The ceramic member prevents the wear of the piezoelectric element, while the vibration damper suppresses useless vibration of the piezoelectric element.

Explanation will now be given with reference to FIGS. 20 to 23. In these figures, a yarn tension sensor 320 is provided on a yarn guide 321 on the winding unit side. It has a bracket 322 formed of an iron plate. In the bracket 322 is provided a piezoelectric element 324 through a vibration damper 323 formed of silicone rubber for example. The overall circumference except one end face of the piezoelectric element 324 is covered with the damper 323 and the bracket 322. A ceramic member 325 is bonded to the exposed end face of the piezoelectric element 324. Yarn 326 contacts the ceramic member 325 and the contact pressure thereof is transmitted to the piezoelectric element 324 by the ceramic member 325. The piezoelectric element 324 generates a predetermined voltage on the basis of the said contact pressure. This voltage is transmitted through a pair of lead wires 327 to a predetermined electric circuit (not shown), which calculates the tension of the yarn on the basis of the said voltage.

The damper 323 is fixed to the bracket 322 with an adhesive and the ceramic material 325 fixed to the piezoelectric element 324 also using an adhesive, provided there may be adopted any fixing method.

Figure 23:
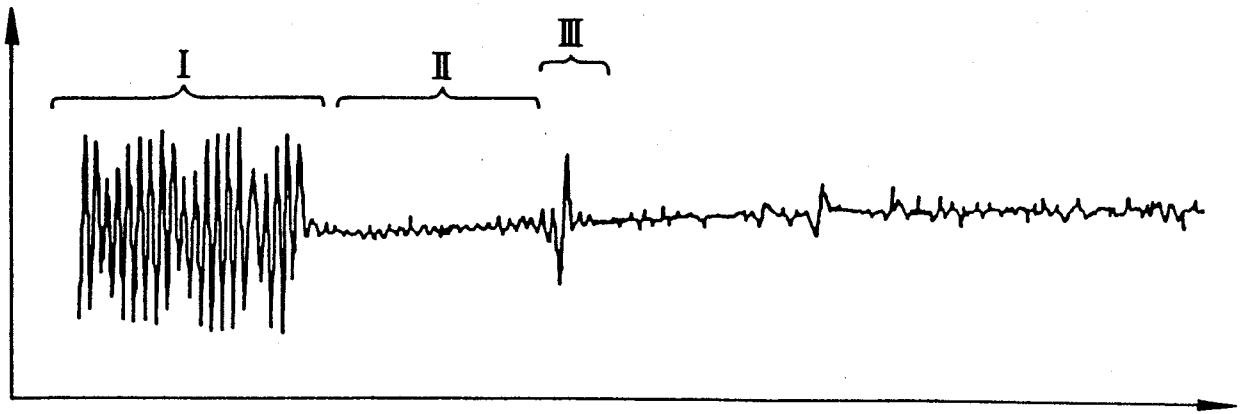
FIG. 23 is a graph of yarn tensions detected by the tension sensor.

FIG. 23 shows the results of tension detection made with respect to the yarn 326 using the yarn tension sensor constructed as above. The range of graph I in FIG. 23 shows that a normal winding operation is performed under oscillation of the yarn 326 on the drum 308. The range of graph II shows that there occurred yarn breakage resulting in decreased contact pressure imposed on the ceramic member 325 and the piezoelectric element 324. Further, the range III shows that the broken yarn began to twine round the drum 308 and the yarn 326 came into strong contact with the ceramic member 325 in the initial state of the twining. Since the piezoelectric element 324 is supported by the damper 323, the oscillation pressure of the piezoelectric element 324 itself is not included in the graph of FIG. 23.

According to the construction of this embodiment in which the tension of yarn is detected by the piezoelectric element supported by the damper, there is obtained a yarn tension sensor capable of detecting a change in yarn tension accurately and positively and thereby detecting yarn breakage without fail. Since the contact pressure of yarn is transmitted to the piezoelectric element through the ceramic member, the wear of the piezoelectric element is prevented and a tension sensor of a long service life is obtained.

What is claimed is:

1. A yarn control device for an automatic winder having a winding unit in which yarn travels with a traversing motion in a path between a yarn defect detector and a traverse drum, the yarn control device comprising:

a tension sensor positioned between the yarn defect detector and the traverse drum and adjacent a location in the yarn travelling path at which the yarn reaches one extremity of the range of motion through which the yarn traverses, the tension sensor including a piezoelectric element for detecting the tension of a travelling a yarn in the winding unit and for generating a tension signal in response thereto, a tensor for controlling the tension of the yarn, and a tension controller for receiving the tension signal form the tension sensor and for providing a command signal to the tensor to thereby control the tension of the yarn, whereby very slight variations in tension of the travelling yarn can be detected, and wherein the tensor comprises:

a shaft, a roller adapted to rotate about the shaft under the tension of yarn which is travelling through the tensor, a solenoid, and means for controlling the tension of the yarn travelling through the tensor, said means including means for moving the solenoid axially with respect to the roller to thereby impart a continuously variable resistance to the rotation of the roller about the shaft.

2. A yarn control device for an automatic winder having a winding unit in which yarn travels with a traversing motion in a path between a yarn defect detector and a traverse drum, the yarn control device comprising:

a tension sensor positioned between the yarn defect detector and the traverse drum and adjacent a location in the yarn travelling path at which the yarn reaches one extremity of the range of motion through which the yarn traverses, the tension sensor including a piezoelectric element for detecting the tension of a travelling a yarn in the winding unit and for generating a tension signal in response thereto, a tensor for controlling the tension of the yarn, and a tension controller for receiving the tension signal form the tension sensor and for providing a command signal to the tensor to thereby control the tension of the yarn, whereby very slight variations in tension of the travelling yarn can be detected, and wherein the tensor comprises:

a fixed disk and a moveable disk in pressure contact with one another, the fixed disk and the moveable disk being configured to hold the travelling yarn therebetween, a support arm for rockably supporting the moveable disk relative to the fixed disk and for moving the moveable disk relative to the fixed disk, and a spring means for controlling the movement of the support arm to thereby control the tension of the travelling yarn held between the fixed disk and the moveable disk.

3. A yarn control device for an automatic winder having a winding unit in which yarn travels with a traversing motion in a path between a yarn defect detector and a traverse drum, the yarn control device comprising:

a tension sensor positioned between the yarn defect detector and the traverse drum and adjacent a location in the yarn travelling path at which the yarn reaches one extremity of the range of motion through which the yarn traverses, the tension sensor including a piezoelectric element for detecting the tension of a travelling a yarn in the winding unit and for generating a tension signal in response thereto, a tensor for controlling the tension of the yarn, and a tension controller for receiving the tension signal form the tension sensor and for providing a command signal to the tensor to thereby control the tension of the yarn, whereby very slight variations in tension of the travelling yarn can be detected, and wherein the tensor comprises:

two gate plates having adjacent, intermeshing surfaces, a plurality of rods projecting from each of the gate plates in a direction substantially parallel to the intermeshing surfaces, the plurality of rods being positioned so that the travelling yarn travels across the surface of each of the rods under tension, a drive mechanism for changing the relative spacing between the two gate plates and thereby changing the degree of engagement of the intermeshing surfaces, whereby the tension of the yarn travelling across the surfaces of the rods is controlled by the relative spacing between the two gates plates.

4. A yarn control device for an automatic winder having a winding unit in which yarn travels with a traversing motion in a path between a yarn defect detector and a traverse drum, the yarn control device comprising:

a tension sensor positioned between the yarn defect detector and the traverse drum and adjacent a location in the yarn travelling path at which the yarn reaches one extremity of the range of motion through which the yarn traverses, the tension sensor including a piezoelectric element for detecting the tension of a travelling a yarn in the winding unit and for generating a tension signal in response thereto, a tensor for controlling the tension of the yarn, and a tension controller for receiving the tension signal form the tension sensor and for providing a command signal to the tensor to thereby control the tension of the yarn, whereby very slight variations in tension of the travelling yarn can be detected, and wherein the tensor comprises:

a fixed friction plate, a moveable friction plate confronting the fixed friction plate, the fixed friction plate and the moveable friction plate being configured to hold the travelling yarn therebetween under tension, a rotatable arm for supporting the moveable friction plate and for moving the moveable friction plate relative to the fixed friction plate, and a solenoid body for controlling the rotation of the rotatable arm to thereby control the tension of the travelling yarn held between the fixed friction plate and the moveable friction plate.

* * * * *